United States Patent [19]

Hall

[11] Patent Number: 4,529,048

[45] Date of Patent: Jul. 16, 1985

[54] INSERTS HAVING TWO COMPONENTS ANCHORED TOGETHER AT A NON-PERPENDICULAR ANGLE OF ATTACHMENT FOR USE IN ROTARY TYPE DRAG BITS

[75] Inventor: David R. Hall, Provo, Utah

[73] Assignee: Megadiamond Industries, Inc., Provo, Utah

[21] Appl. No.: 459,413

[22] Filed: Jan. 20, 1983

Related U.S. Application Data

[63] Continuation-in-part of Ser. No. 433,048, Oct. 6, 1982.

[51] Int. Cl.[3] ..... E21B 10/46

[52] U.S. Cl. ..... 175/410; 175/329; 407/118

[58] Field of Search ..... 175/410, 411–413, 175/409, 329, 330; 299/91, 93; 407/118

[56] References Cited

U.S. PATENT DOCUMENTS

| | | | |
|---|---|---|---|
| 3,751,114 | 8/1973 | Davis | 299/93 |
| 4,109,737 | 8/1978 | Bovenkerk | 175/329 |
| 4,200,159 | 4/1980 | Peschel et al. | 175/410 |
| 4,265,324 | 5/1981 | Morris et al. | 175/329 |
| 4,333,540 | 6/1982 | Daniels et al. | 175/329 |
| 4,334,585 | 6/1982 | Upton | 175/329 |
| 4,382,477 | 5/1983 | Barr | 175/410 |

FOREIGN PATENT DOCUMENTS

| | | | |
|---|---|---|---|
| 629523 | 10/1961 | Canada | 407/118 |
| 2056381 | 5/1972 | Fed. Rep. of Germany | 175/410 |
| 2037629 | 7/1980 | Fed. Rep. of Germany | 407/118 |
| 3248 | of 1873 | United Kingdom | 299/93 |
| 579404 | 11/1977 | U.S.S.R. | 175/330 |
| 781341 | 11/1980 | U.S.S.R. | 299/91 |

*Primary Examiner*—James A. Leppink
*Assistant Examiner*—Hoang C. Dang
*Attorney, Agent, or Firm*—Neuman, Williams, Anderson & Olson

[57] ABSTRACT

An insert for a rotary type drag bit having two anchored components, an engaging element and a shank, is disclosed. The components are positioned into each other in interfitting relationship with the mating surfaces of the two components being at a non-perpendicular angle to a plane parallel to the front of the engaging element. This insert can then be placed into a receiving feature on the crown of a drill bit. The resulting engaging element to shank interface enables the forces encountered during drilling to be distributed over a larger surface area than conventional flat-on-flat two component attachments so that the bond is less likely to break. The effect of the drilling forces on the engaging element to shank interface is also reduced as the shearing forces are diminished and resolved into compressive forces and the shank provides a support for the interface bond against any remaining shearing forces.

2 Claims, 10 Drawing Figures

FIG. 1A PRIOR ART
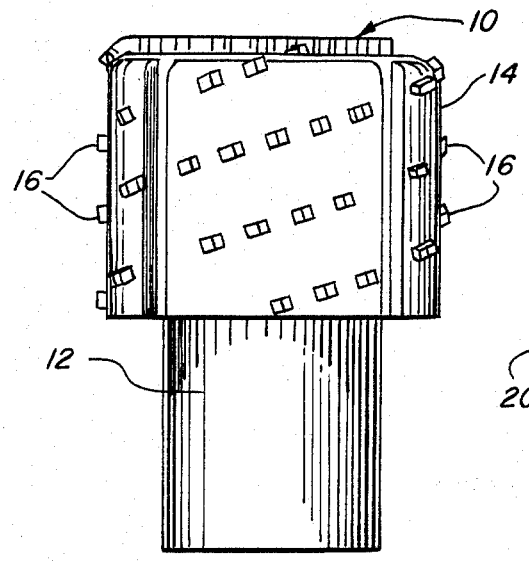
FIG. 1B PRIOR ART
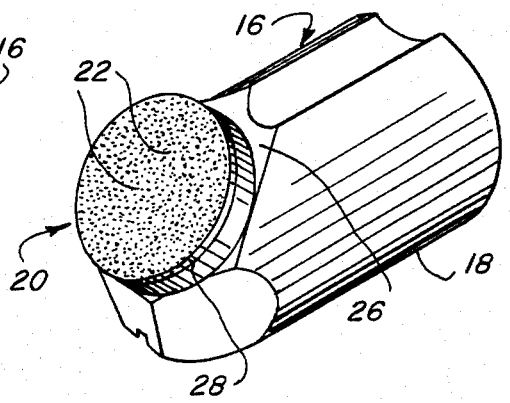
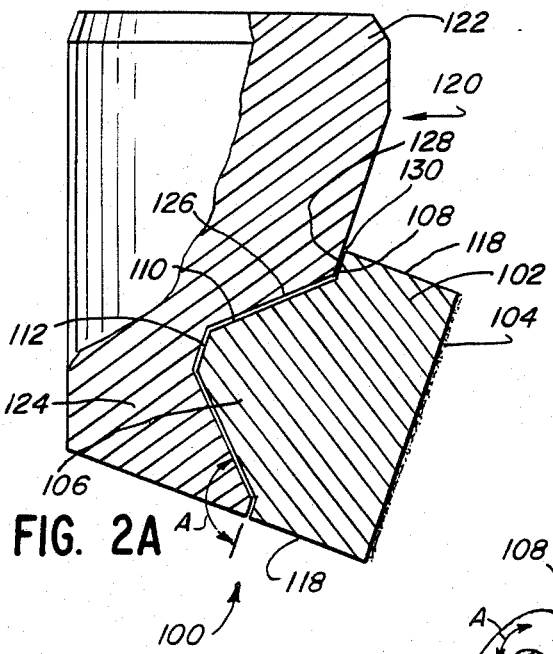
FIG. 2A
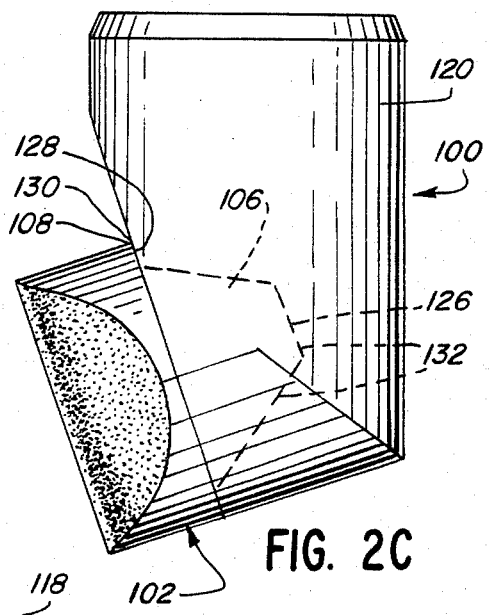
FIG. 2C
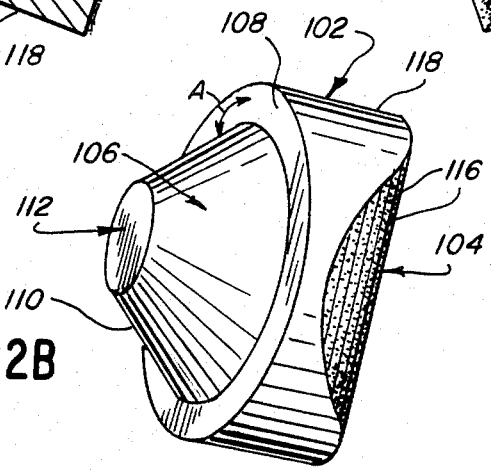
FIG. 2B FIG. 3
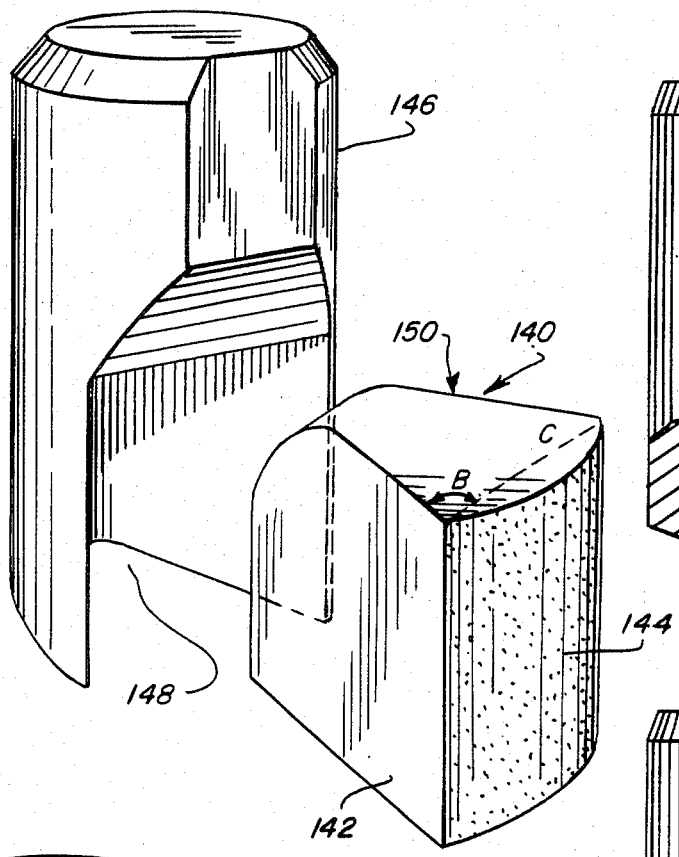
FIG. 4
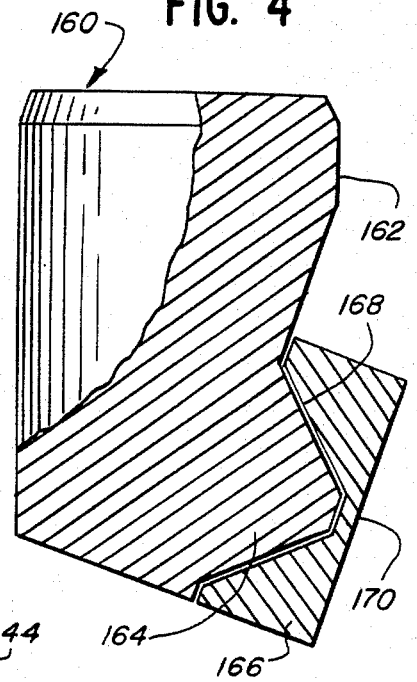
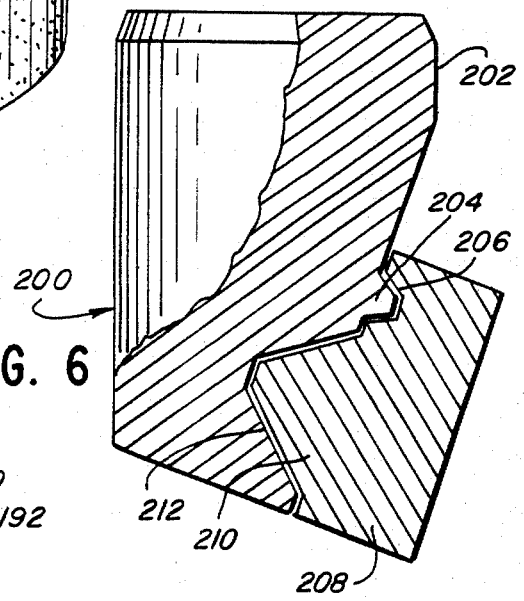
FIG. 6
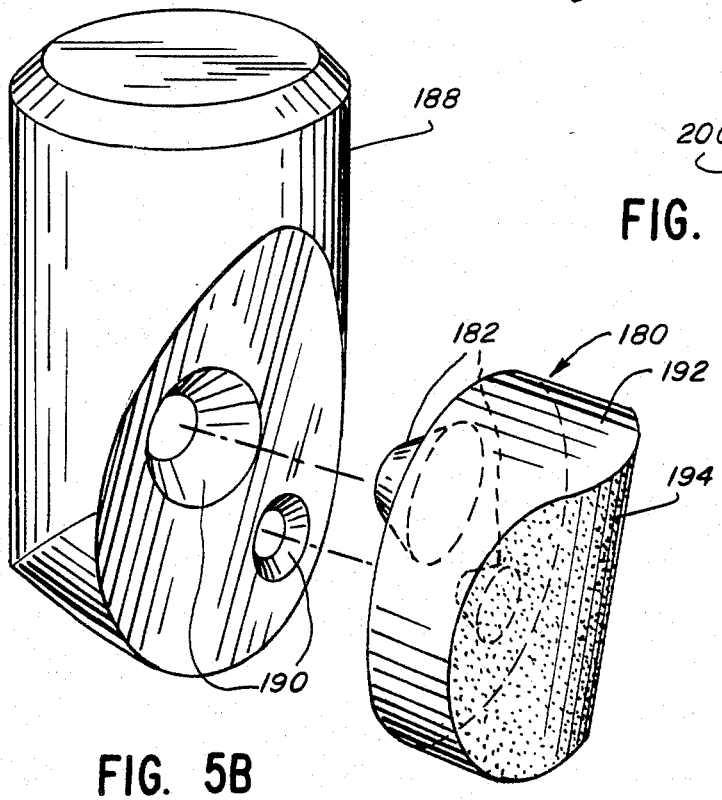
FIG. 5B
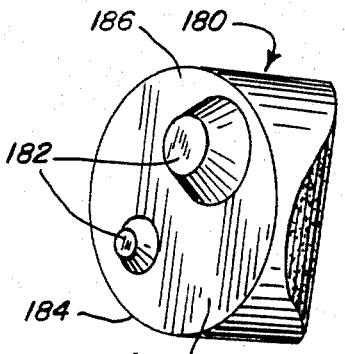
FIG. 5A

INSERTS HAVING TWO COMPONENTS ANCHORED TOGETHER AT A NON-PERPENDICULAR ANGLE OF ATTACHMENT FOR USE IN ROTARY TYPE DRAG BITS

This application is a continuation-in-part of application Ser. No. 433,048, filed Oct. 6, 1982, for "Curved Contact Portion on Engaging Elements for Rotary Type Drag Bits."

BACKGROUND OF THE INVENTION 1. Field of the Invention

This invention relates to inserts for drag type rotary drill bits. More particularly, the invention relates to inserts comprising two components having an engaging element and a shank element which are connected together by brazing. A super abrasion resistant material is deposited upon one surface of the engaging element and this surface is used as the contact surface of the insert. A plurality of these anchored two component drill bit inserts are inserted into the crown of a drill bit.

2. Prior Art

The application of superhard material such as sintered polycrystalline diamond compacts to the contact portion or working surface of the engaging elements in rotary type drag bits is well known. The use of superhard material has extended the life expectancy of the drag bits, has allowed the design and development of rotary type drag bits with more agressive cutting actions and has improved penetration rates.

Several forms of drill bit inserts have been developed to take advantage of the properties of these super hard materials. One such structure of drill bit inserts involves a two component system comprising an engaging element and a shank. The engaging element in these inserts is a cemented carbide substrate in the shape of a cylindrical disc with a layer of polycrystalline diamond bonded to the substrate. The reverse surface of the engaging element is mounted onto the carbide shank which is then inserted into the crown of a drill bit. The cylindrical disc shaped carbide substrate is bonded to the carbide shank forming a flat-on-flat attachment area between the engaging portion and the shank portion. This prior art structure is shown in FIG. 1B. However, since the layer of super hard material, polycrystalline diamond for example, is physically close to the flat-on-flat bonding area and the diamond's crystalline structure degrades above certain temperatures the methods of forming the flat-on-flat bond are limited. The flat-on-flat bond can be accomplished by brazing provided the braze material becomes liquid below the degradation temperature limit of the polycrystalline diamond material. Thus, the type of braze material which can be used is limited. Other more complicated and expensive methods involving the use of heat sinks to protect the polycrystalline diamond material can also be used to form the flat-on-flat bond.

The two component insert is particularly useful since the length of the shank can be varied to provide the bit with a greater range of cutting depth and the rake or angle at which the engaging element contacts the rock can be varied by simply substituting inserts with engaging elements mounted to the shank at different angles rather than changing the structures on the crown. Nevertheless the prior art two component inserts with the flat-on-flat attachment between the engaging element and the shank has a number of defects. First, the engaging element, under the stresses encountered in drilling, can become unattached from the shank since the flat carbide surface of the engaging portion is generally brazed to a planar or flat surface on the shank. The angle of this planar interface between the engaging element and the shank to a vertical axis, for an optimum rake for cutting, is 10° to 20°. The flat-on-flat bond set at this particular angle is subjected to shear forces resulting from forces exerted on the engaging element from the bottom of the hole being drilled. These forces work to break the bond and separate the engaging element from the shank.

Second, the forces that are exerted on the cutting surface of the engaging element when it contacts new material are concentrated at the bottom-most portion of the engaging element. Due to the heterogeneous nature of rock, there is also a great deal of recurring side to side imbalance. This concentration of forces at the bottom most portion of the engaging element coupled with the imbalance of loads on the engaging element which occurs over the course of the drilling process weakens the flat-on-flat bond between the engaging element and the shank.

Third, with the prior art structure it is difficult to properly position the cylindrical disc shaped engaging element onto the shank. Since the positioning of the engaging element onto the shank requires a flat-on-flat bond, there is no way to assure that the engaging element is symmetrically positioned. Any even slight misalignment between the engaging element and the shank exaggerates the forces working to separate or break the flat-on-flat bond.

Fourth, if the flat-on-flat bond between the engaging element and the shank is formed by brazing, the braze material used must have a low melting point in order to prevent degradation of the crystalline structure of the polycrystalline diamond material as explained above. This limits the choice of brazing materials. When a braze material with a low melting temperature is used to prevent degradation of the polycrystalline diamond material during the bonding of the engaging element to the shank, the high temperatures created during the drilling operation cause this brazed bond to weaken thereby encouraging a break or fracture in the bond. The alternative methods of forming the flat-on-flat bond between the engaging element and the shank are expensive and time consuming which results in higher manufacturing cost for the inserts.

OBJECTS OF THE INVENTION

It is therefore the general object of the present invention to alleviate the aforementioned problems. It is another general object of this invention to provide a two component drill bit insert where the engaging element and shank are positioned in interfitting engagement relative to each other such that the angle of attachment of the two components is non-perpendicular. It is another general object of this invention to provide a two-component drill bit insert where the load is distributed over a larger surface area between the engaging element and the shank. It is another general object of this invention to provide a two-component drill bit insert where the imbalance of forces on the insert during the drilling process does not cause the detachment of the engaging element from the shank. It is yet another general object of this invention to provide for the accurate positioning of the engaging element to the shank. It is yet another general object of this invention to provide a two component drill bit insert where the interface of the engaging element and shank is located at a sufficient distance from the polycrystalline diamond or other super abrasive material that braze materials with a wider range of melting temperatures can be used without causing a degradation of the super hard material due to heat during the brazing operation.

It is a specific object of the present invention to provide a two component drill bit insert for a rotary type drag bit wherein the engaging element is positioned and pocketed into a recessed portion or aperture in the shank so that the interface angles with respect to the forces exerted on the engaging element resolve these forces into compressive forces rather than shear forces and thereby improve the strength of the attachment of the engaging element to the shank. It is another specific object of the present invention to provide a two-component insert for a rotary-type drag bit wherein the shank and engaging elements are anchored together such that the angle of the interface of the two components with respect to a plane parallel to the back of the engaging element is non-perpendicular. It is another specific object of the present invention to provide a two-component insert for a rotary-type drag bit wherein the shank is positioned and pocketed into a recessed portion of the engaging element so that the forces exerted on the engaging element relative to the engaging element and shank interface are resolved into compressive forces rather than shear forces and thereby improve the strength of the attachment of the engaging element to the shank. It is another specific object of this invention to provide a two-component insert for a rotary type drag bit wherein a portion of the shank is positioned and pocketed into a recess or receiving portion of the engaging element and a portion of the engaging element is positioned and pocketed into a recess or receiving portion of the shank thereby improving the strength of the attachment of the engaging element to the shank. It is another specific object of the present invention to provide a two-component insert for a rotary-type drag bit wherein the positioning and pocketing of the engaging element and the shank provides a greater surface area at the shank/engaging element interface thereby providing a greater area available for brazing which also improves the strength of the attachment of these two pieces. It is yet another specific object of the invention to provide an anchor on the engaging element which is pocketed into a shank so that the location of the shank-/engaging element attachment is farther away from the point where the engaging element contacts the rock. It is yet another specific object of this invention to provide a drill bit insert for a rotary type drag bit wherein the angle between the engaging element and the shank is readily and accurately located by positioning and pocketing the shank with the engaging element.

These and other objects will become apparent as a detailed description proceeds.

SUMMARY OF THE INVENTION

The present invention is an insert for a rotary type drag bit having two components, a shank and an engaging element, which are positioned into each other in interfitting relationship with the mating surfaces of the two components being at a non-perpendicular angle to a plane parallel to the front of the engaging element. This two component insert is then suitable for placement in a receiving feature on the crown of the drill bit.

In one embodiment of the invention the integral engaging element comprises a contact portion and an anchor or stem portion. The contact portion has a superhard abrasive material deposited on one face and at the back face the anchor or stem portion is formed in the shape of a truncated cone. The top end of the shank has a receiving recess corresponding to the shape of the anchor portion of the engaging means. The anchor portion of the engaging element is positively positioned and pocketed into the receiving recess of the shank. The engaging element is held in place in the recess of the shank by brazing, welding or any other type of bonding method. The bottom end of the shank is then inserted into a hole in the crown of a drill bit.

In another embodiment of the invention, the anchor portion of the engaging element is in the shape of a wedge or V. This wedge shaped anchor is positively positioned and pocketed into and bonded to a corresponding receiving recess of the shank.

In yet another embodiment of the invention, the top end of the shank has a protrusion in the shape of a truncated cone. The back face of the engaging element has a receiving recess corresponding to the shape of the protrusion on the shank. The protrusion of the shank is positively positioned and pocketed into and bonded to the engaging element.

In yet another embodiment of the invention, the engaging element has multiple anchors in the shape of truncated cones protruding from its back surface. The top end of the shank has a corresponding number of recesses substantially similar in shape to the anchors of the engaging element. These anchors are then positively positioned and pocketed into and bonded to the corresponding recesses in the shank. The bottom end of the shank is then inserted into a hole in the crown of the drill bit. Of course, the mirror image structure with multiple protrusions in the shape of truncated cones from the shank and corresponding recesses in the engaging element is also contemplated.

In yet another embodiment of the invention, both the back surface of the engaging element and the top end of the shank have anchors in the shape of truncated cones protruding from their surfaces. The back surface of the engaging element and the shank both have recesses correspondin in shape to the respective anchors in the other element. The anchors are then positively positioned and pocketed into and bonded to the corresponding recesses. The bottom end of the shank is then inserted into a hole in the crown of the drill bit.

DESCRIPTION OF THE DRAWINGS

The present invention will be more clearly understood from the following detailed, description of specific embodiments, read in conjunction with the accompanying drawings, wherein:

FIG. 1A is a perspective drawing showing the prior art where the crown of the drill bit has a plurality of two-component drill bit inserts.

FIG. 1B is a perspective drawing showing a prior art drill bit insert of the type used in the drill bit crown in FIG. 1A.

FIG. 2A is an elevational view of the reversed side of FIG. 2C with a portion broken away to expose the internal surface of the shaft and the truncated cone portion of the engaging element.

FIG. 2B is a perspective drawing showing the truncated cone portion of the engaging element in FIG. 2A.

FIG. 2C shows a side view of a two component drill bit insert made in accordance with the present invention: an engaging element with its abrasive-faced contact portion fitted into the stud which forms the main shaft or shank of the insert.

FIG. 3 shows an exploded perspective view of a wedge shaped engaging, element and a stud or shank with a corresponding pocket.

FIG. 4 shows a side view of a two-component drill bit insert with a portion broken away showing its shank or stud with a protrusion fit into the engaging element with its abrasive-faced contact portion.

FIG. 5A shows a perspective view of an engaging element in accordance with this invention with two protrusions or anchors from the back side of the engaging element for pocketing and positioning into the stud or shank of the insert.

FIG. 5B shows an exploded perspective view of the engaging element of FIG. 5A and a shank with corresponding recesses for pocketing the engaging element into the shank.

FIG. 6 shows a side view of a two component drill bit insert with a portion broken away showing an anchor of the shank fit into the engaging element and an anchor of the engaging element fit into the shank of the insert.

It should be understood that the drawings are not necessarily to scale and that the embodiments are illustrated by graphic symbols, diagrammatic representations and fragmentary views. In certain instance, details which are not necessary for an understanding of the present invention or which render other details difficult to perceive may have been omitted. It should be understood, of course, that the invention is not necessarily limited to the particular embodiments illustrated herein.

DETAILED DESCRIPTION

FIG. 1A shows a typical prior art rotary drill bit 10 with an elongated shaft 12 and a drill bit crown 14 in which a plurality of inserts 16 are mounted. FIG. 1B shows a perspective view of one of the inserts 16 from FIG. 1A. The insert 16 comprises a shank 18 and a cylindrical disc shaped engaging member 20. The disc shaped engaging member 20 comprises a thin layer of polycrystalline diamond (or other known superabrasive material) 22 bonded to a sintered carbide substrate 24. The disc 20 is mounted onto a flat surface 26 formed in shank 18. The disc 20 is usually attached by brazing or soldering the flat surface of the disc 20 onto the flat surface 26 of the shank forming a flat-on-flat bond 28.

FIG. 2A shows a partial cross-sectional side view of a two component drill bit insert 100 made in accordance with the present invention and is the preferred embodiment. A portion is broken away to expose a cross section of the internal surface of the shank 120 and the engaging element 102. The engaging element 102 comprises a contact portion 104 and an anchor or stem portion 106. The anchor portion 106 is integral with and projects from the back surface 108 of contact portion 104. The anchor portion 106 has the shape of a truncated cone with a side surface 110 and a top surface 112. The shape of the anchor 106 is best shown in FIG. 2B. The angle of attachment A between a plane parallel to the back surface 108 and the side surface 110 of the anchor 106 is non-perpendicular.

Another way to define the non-perpendicular relationship is with reference to the angle between the mating surfaces of the recess of the shank and the sides or surfaces of the anchor and a plane parallel to the front surface of the contact portion 104. The contacting portion 104 of the engaging element 102 as shown in FIG. 2A has an abrasive material 116 deposited thereon. The shape of the front surface of the contacting portion 104 of the engaging element 102 does not form any part of the present invention and can be either flat as shown in the prior art of FIG. 1B or curved as shown in the parent application Ser. No. 433,048, for Curved Contact Portion on Engaging Elements for Rotary Type Drag Bits filed Oct. 6, 1982. If this surface is curved, the parallel plane referred to above is the plane parallel to the foremost surface area. It should also be understood that other shapes of anchor portions meeting the limitations set forth herein are contemplated and are considered within the scope of the present invention.

The anchor or stem portion 106 of the engaging element 102 as shown in cross section in FIG. 2A has a side wall surface 110. The back surface 108 and the side portion 118 of the contacting portion 104 are also shown in FIG. 2A. Corresponding numbers have been placed on FIG. 2B to further illustrate the invention.

The shank 120 as a top end 122 and a mounting end 124 with a recess 126. As shown in the above referenced parent application, the insert 100 has a vertical axis or shaft axis which extends through the center of the shank 120 from the top end 122 to the mounting end 124. The anchor portion 106 of the engaging element 102 in FIG. 2A is positioned and pocketed into the aperture or recess 126 in the mounting end 124 of the shank 120. When the engaging element 102 is properly positioned in the recess 126, the back surface 108 of the contact portion 104 is butted up to the brace portion 128 of the shank 120 to form a joint 130. The side 118 of the contacting portion 104 remains exposed. The top end 122 of the shank 120 may be interference fit into or otherwise held in a corresponding hole in the crown of a drill bit (not shown). The engaging element 102 and shank 120 can be attached by brazing, welding or bonding the anchor position 106, comprising the side wall surface 110, top surface 112, and the back surface 108 to the recess 126 in the mounting end 124 of the shank 120 and the 128.

FIG. 2B is a perspective drawing of the integral engaging element 102 in FIG. 2A. The anchor portion 106 is in the shape of a truncated cone and projects from the back surface 108 of the contact portion 104.

FIG. 2C shows a side view of the drill bit insert 100 made in accordance with the present invention. Phantom lines show the engaging element 102 fit into the recess 126 of the shank 120. As stated and illustrated in the above referenced parent application, the attachment of the engaging element 102 to the shank 120 provides for a preselected negative rake while allowing the top end 122 of the shank to be placed perpendicularly into the crown of a drag bit. This negative rake facilitates the cutting and drilling operations. The resulting two component anchored drill bit insert thus has an engaging element to shank interface 132 comprising a greater surface area than the flat-on-flat bond 28 of FIG. 1B. The force per unit area applied to the engaging element to shank interface 132 during the drilling operation is therefore decreased. Of course this distribution of the force over a greater surface area makes the interface bond 132 less likely to break during drilling. In addition to decreasing the force per unit area, anchoring the engaging element 102 in the recessed portion 126 of the shank 120 at a non-perpendicular angle with a plane parallel to the foremost surface of the engaging element affects the impact of the drilling forces on the insert in two other ways. First, by changing the location of the engaging element/shank bond, the shearing component of the force is diminished and the normal or perpendicular component of the drilling force is increased. As a result, the forces are resolved into compressive forces which do not tend to fracture or break the interface bond 132. Second, the effect of the reduced shearing component of the drilling force in the anchored two component insert is less detrimental than with prior art inserts since the shank 120 provides a support for the interface bond 132 against any remaining shearing component of the force and absorbs the impact of these shearing forces.

Another advantage of this anchored two component insert is the ability to repeatably accurately position the engaging element 102 with respect to the shank 120. Once the engaging element 102 is settled within the recess 126 of the shank 120 it is at the proper angle and position. Movement of the engaging element 102 during bonding is prevented by the walls of the recess 126 thereby preventing misalignment of the engaging element to the shank which in the prior art flat-on-flat bond is commonplace and which tends to make the bond more susceptible to breaking under the shearing forces incurred during the drilling operation. The positive setting of the engaging element 102 with the recess 126 of shank 120 is indicated by the abutment of the back 108 of the engaging element 102 to the brace portion 128 of the shank 120 to form a joint 130.

The anchor portion or stem 106 being positioned within the shank 120 also increases the distance from the contacting portion 104 to the interface bond 132 so that the heat generated from drilling does not affect the engaging element to shank interface 132 as greatly as it does in the flat-on-flat bond 28 of the prior art as shown in FIG. 1B.

FIG. 3 shows an exploded perspective view of yet another embodiment of the invention. The engaging element 140 is in the shape of a wedge with two interface sides 142 which is cut from a polycrystalline/carbide piece in the shape of a cylinder (not shown). A cross section of the contacting portion 144 of the engaging element 140 is an arc. The angle between a chord C of this arc and the interface sides 142 is the angle of attachment B which is non-perpendicular. The shank 146 has a recess 148 at one end. The wedge shaped engaging element 140 is positioned and pocketed into the recess 148 of the shank 146. The contacting portion 144 remains outside of the recess so that only the wedge portion 150 is bonded, brazed or welded to the shank 146.

FIG. 4 shows a cut away side view of a two-component insert 160 which is another embodiment of the invention. The shank 162 has an anchor portion or protrusion 164 at the mounting end in the shape of a truncated cone. The engaging element 166 has a recess or receiving portion 168 reverse to the face of the contacting portion 170. The anchor or protrusion portion 164 of the shank 162 is positioned and pocketed into the recess 168 of the engaging element 166.

FIG. 5A shows the engaging element 180 of yet another alternative embodiment of this invention. This engaging element 180 has two anchors or protrusions 182 on the back 184 of the engaging element 180. There is a brace portion 186 over the remaining area of the back 184. These anchors 182 are in the shape of a truncated cone.

FIG. 5B shows an exploded perspective view of the engaging element 180 of FIG. 5A with its two anchors 182 and the shank 188 with corresponding apertures or recesses 190. The anchors 182 are positioned and pocketed into the recesses 190 of the shank 188 to form a mating profile which is non-linear or in the form of a convoluted line. The ledges 192 and contacting portion 194 remaining exposed from the shank 188.

FIG. 6 shows a cut away side view of a two-component insert 200 which is yet another embodiment of this invention also having a non-linear or convoluted mating profile. The shank 202 has an anchor portion or protrusion 204 in the form of a truncated cone at its mounting end which is positioned and pocketed into a recess 206 located in the back portion of an engaging element 208. The engaging element 208 also has an anchor portion or protrusion 210 in the form of a second truncated cone which is positioned and pocketed into a recess 212 located in the mounting end of the shank 202.

It should be understood by a person skilled in the art that other embodiments of this invention exist. It is not necessary that the anchors or protrusions on the engaging element or those on the shank be of the same size or cross section. Furthermore, the particular number of anchors is not critical. The essential thing is that the engaging portion and shank are positioned in interfitting engagement relative to each other and the angle of attachment which is the angle between a plane parallel to the foremost surface of the contacting portion of the engaging element and the interface of the engaging element and shank is not perpendicular From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. An insert for a rotary drag bit which is used for material cutting purposes comprising:

an engaging element having a central axis, an anchoring end, a contacting surface end with a super abrasive material desposited thereon, and a side portion substantially concentric about said central axis and connecting said anchoring end and said contacting surface end, said central axis passing through said contacting surface end and said anchoring end, and said anchoring end having a back surface and more than one protrusion extending outwardly from said back surface;

a shank portion with a shank axis and having a fitting end for inserting in said rotary drag bit and a receiving end for receiving said engaging element, said receiving end having more than one recess;

said protrusions of said anchoring end of said engaging element having sloping walls which meet said back surface at a non-perpendicular angle, said protrusions mating in interfitting relation with said recesses of said receiving end of said shank portion and forming a mating profile such that said mating profile is in the form of a convoluted line; and said central axis intersecting said vertical axis at an obtuse angle and said contacting surface end of said engaging element is positioned at a negative rake for material cutting.

2. An insert as in claim 1 wherein each of said protrusions having a predetermined shape and each of said recesses having a predetermined shape which is substantially the same as the shape of the corresponding and mating one of said protrusions.

* * * * *